US011265640B2

(12) United States Patent
Peeters et al.

(10) Patent No.: US 11,265,640 B2
(45) Date of Patent: Mar. 1, 2022

(54) HEADPHONE ASSEMBLY AND HEADPHONE CONTROLLING METHOD

(71) Applicant: TYMPHANY ACOUSTIC TECHNOLOGY (HUIZHOU) CO., LTD., Huizhou (CN)

(72) Inventors: Thomas Pieter J. Peeters, Huizhou (CN); Hung-Fen Chen, Huizhou (CN); Hung-Wei Lee, Huizhou (CN); Chia-Hsin Hung, Huizhou (CN)

(73) Assignee: TYMPHANY ACOUSTIC TECHNOLOGY (HUIZHOU) CO., LTD., Huizhou (CN)

( * ) Notice: Subject to any disclaimer, the term of this patent is extended or adjusted under 35 U.S.C. 154(b) by 1 day.

(21) Appl. No.: 16/837,062

(22) Filed: Apr. 1, 2020

(65) Prior Publication Data

US 2020/0322710 A1 Oct. 8, 2020

Related U.S. Application Data

(60) Provisional application No. 62/829,163, filed on Apr. 4, 2019.

(51) Int. Cl.
*H04R 1/10* (2006.01)

(52) U.S. Cl.
CPC ..... *H04R 1/1041* (2013.01); *H04R 1/1075* (2013.01)

(58) Field of Classification Search
CPC .. H04R 1/1041; H04R 1/1008; H04R 1/1075; H04R 1/1091; H04R 2460/01; H04R 29/00; H04R 1/1016; H04R 1/1058; H04R 2201/107; H04R 1/1033; H04R 2420/01; H04R 3/12; H04R 5/033; H04R 5/04; H04R 1/1083; H04R 2420/07; H04R 2460/03; H04R 2499/15; H04M 1/05; H04M 1/2155; H04M 1/60; H04M 1/72478; H04M 1/6058; H04M 1/72442; H04M 2250/12; H04N 5/765; H04N 5/91; A61B 3/113; A61B 5/024; A61B 5/18; A61B 5/4809; A61B 5/4812; H04B 1/3838; H04L 49/10; H04W 72/085
USPC ..... 381/74, 123, 1, 150, 370, 300, 309, 371, 381/372
See application file for complete search history.

(56) References Cited

U.S. PATENT DOCUMENTS

2010/0246807 A1* 9/2010 Kemmochi ..... H04M 1/05 379/441
2014/0211959 A1* 7/2014 Boyajian ..... H04R 5/033 381/74
2016/0366507 A1* 12/2016 Hou ..... H04R 1/1041
2018/0039086 A1* 2/2018 Jiang ..... G02B 27/0176

* cited by examiner

*Primary Examiner* — Lun-See Lao
(74) *Attorney, Agent, or Firm* — Muncy, Geissler, Olds & Lowe, P.C.

(57) ABSTRACT

A headphone assembly, including: a switching element for controlling a switch of at least one functional element in a headphone; a pressure sensor accommodated in a groove of a speaker board; and an ear pad covering the groove, when the ear pad is pressed, a trigger element may be moved to press against the pressure sensor, when detecting that pressure applied by the trigger element reaches a predetermined range, the pressure sensor switches on the switching element, otherwise, the pressure sensor switches off the switching element.

10 Claims, 6 Drawing Sheets

HEADPHONE ASSEMBLY AND HEADPHONE CONTROLLING METHOD

CROSS-REFERENCE(S)

This application claims priority to U.S. Provisional Application No. 62/829,163, filed on Apr. 4, 2019, the content of which is hereby incorporated by reference in its entirety.

TECHNICAL FIELD

The present application generally relates to the field of stereo equipment and, more particularly, to a headphone assembly and a headphone controlling method.

BACKGROUND

Wearing detection of a headphone (e.g., automatically detecting by one or more components of a headphone whether the headphone is being worn by a user) can increase convenience of using the headphone. Currently, wearing detection of a headphone may be implemented through an infrared sensor, a capacitance (CAP) sensor, a gravity (G) sensor, or other active sensing elements located in an ear pad or a headband.

Such techniques, however, may be limited. For example, detection through the infrared sensor may be limited by a distance, a space, and/or a required opening in the headphone, which may occupy a large area of the headphone. Detection through the CAP sensor usually requires a complex system load to avoid increasing temperature interference during wearing for a long time. Detection through the gravity sensor may have poor performance in recognition rates, which may cause unreliable wearing detection results.

DETAILED DESCRIPTION

Figure 1:
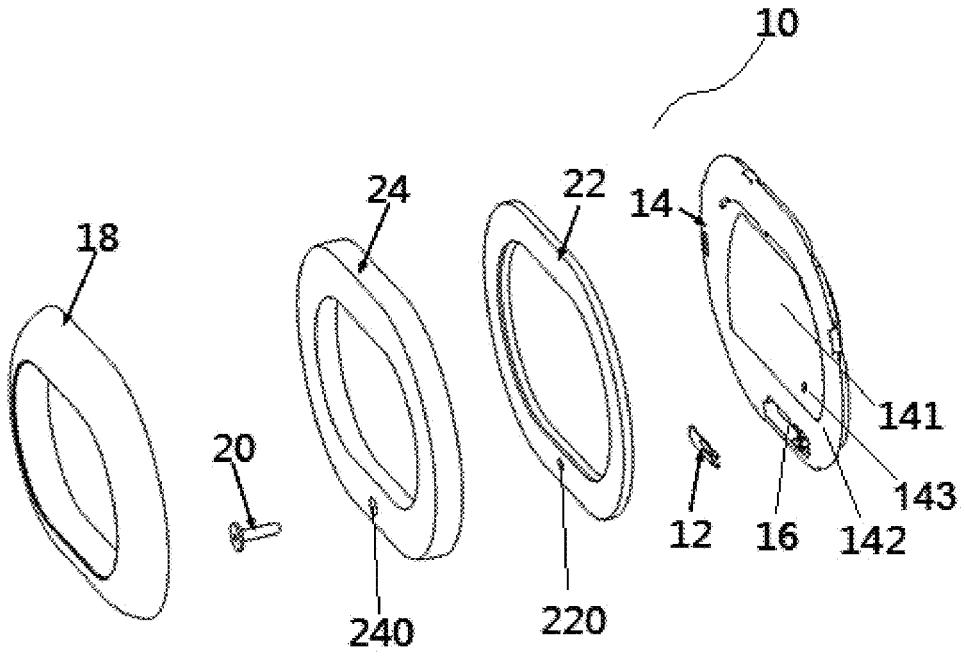
FIG. 1 is a schematic exploded diagram of a structure of an example headphone assembly according to some embodiments of the present application.

The following description provides many different examples for implementing different features of various disclosed embodiments. Examples of components and arrangements are described below to describe embodiments of the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features such that the first and second features may not be in direct contact. In addition, the present disclosure may repeat reference numerals and/or letters in the various examples.

This repetition is for the purpose of clarity and does not in itself dictate a relationship between the various embodiments and/or configurations discussed.

Further, spatially relative terms, such as "beneath," "below," "lower," "above," "upper," or the like, may be used herein for ease of description to describe one element or feature's relationship to another element(s) or feature(s) as illustrated in the figures. The spatially relative terms are intended to encompass different orientations of the device (e.g., in use or operation) in addition to the orientation depicted in the figures. The apparatus may be otherwise oriented (e.g., rotated 90 degrees or at other orientations), and the spatially relative descriptors used herein may likewise be interpreted accordingly.

As shown in FIG. 1 to FIG. 4, the present application provides a headphone assembly 10 and a method that may be used to control a headphone, such as headphone assembly 10. The headphone assembly 10 may include a switching element 143 for controlling a switch of at least one functional element in an headphone, a pressure sensor 12 accommodated in a groove 16 of a speaker board 14, and an ear pad 18 covering the groove 16. In some embodiments, when the ear pad 18 is pressed, a trigger element 20 may be moved to press against the pressure sensor 12. When detecting that the pressure applied by the trigger element 20 reaches a predetermined range, the pressure sensor 12 may switch on the switching element 143. Otherwise, the pressure sensor may switch off the switching element 143. The speaker board 14 may be a panel member cooperatively connected to a speaker 15 and may have a grille part 141 corresponding to a membrane 150 of the speaker 15. The grille part 141 may transmit audio of the speaker. The speaker board 14 may have an annular part 142 surrounding the grille part 141, and the groove 16 may be disposed on the annular part 142. The annular part 142 of the present application may have a smaller size compared to that of a conventional headphone assembly. That is, the pressure sensor 16 of the present application may be located on a peripheral side of the speaker board 14, and may be arranged such that it does not occupy most of an area of the speaker board 14. However, a conventional sensor, such as an infrared (IR) sensor or a capacitance (CAP) sensor, may require a larger area on the speaker board 14 in order to achieve a level of sensitivity required for use.

In some embodiments, when a user wears the headphone, ears of the user may contact the ear pad 18, so that the ear pad 18 may receive pressure from the ears of the user, thereby enabling the ear pad 18 to press the trigger element 20. Further, the trigger element 20 may be pressed through the ear pad 18, and the pressed trigger element 20 may be moved toward the pressure sensor 16 disposed in the speaker board 14 such that the trigger element engages (e.g., presses on) the pressure sensor 16. A pressure value applied by the trigger element 20 may be detected by the pressure sensor 16, and at least one functional element of the headphone may be controlled (e.g., switched on) in response to the pressure value reaching a certain level or a predetermined range. Otherwise, the at least one functional element may remain switched off.

According to some embodiments of the present application, the speaker board may be provided with a circuit board, the pressure sensor 12 may be connected to electronic components on the circuit board, and the switching element 143 may be connected or integrated with the circuit board. In one embodiment, the switching element 143 may include an electronic element within the circuit board or a physical switching element. In one embodiment, the at least one functional element may include a noise reduction element, a voice call element, a speaker 15, a Bluetooth element, or the like, and the functional elements may be connected or integrated with the circuit board. In one embodiment, the pressure sensor 12 may be connected to a processor. The processor may convert the sensing signal of the pressure sensor 12 into a control signal and transmit it to each of the functional element to switch on or switch off the at least one functional element. When the trigger element 20 is separated from the pressure sensor 16, the at least one functional element may be switched off. In some embodiments, the headphone assembly 10 may be used for a headset and may be used for a portable Bluetooth (BT) headphone. In some embodiments. when the pressure sensor 12 is triggered, a system can automatically play music, answer a call, or turn on an active noise reduction (ANC) function. When the pressure sensor 12 senses that the headphone has been removed from the user's ears (e.g., the pressure sensor 12 is not triggered), the system may pause music, send a call to a phone, turn off ANC, or turn off an input/output (I/O) device automatically to save power and avoid accidents caused by inadvertent contact.

Use of the pressure sensor 12 may offer several advantages. For example, the pressure sensor 12 may occupy smaller areas of the headphone relative to certain other sensing techniques, and the pressure sensor may avoid significant electrical loads on headphone electrical components. The pressure sensor technique may also offer higher rates of positive wearing detection compared to certain other sensing techniques. The pressure sensor 12 may be configured as a passive element that changes its resistance or capacitance when pushed or pressed, which may enable quick and easy detection of whether the user wears a headphone. When the user wears the headphone, the trigger element 20 may be pushed by the ear pad 18, and the trigger element 20 may be moved so that the pressure sensor 12 is pushed by the trigger element 20. In this case, the pressure sensor 12 can sense a wearing behavior of the user. The pressure sensor 12 may be located in the groove 16 of the speaker board 14. Compared with certain existing sensing methods, the pressure sensor 12 may not require a large plane for sensing a user's body to sense a wearing behavior of the user, and may occupy a relatively small volume in the headphone, so that an integration level of the headphone may be higher. The headphone assembly 10 may provide a compact and portable headphone in limited space and even where limited battery capacity is available without compromising the user experience. The pressure sensor 12 may have high sensitivity, and therefore may offer an improved user experience relative to other techniques that cannot offer similar positive rates of wearing detection. In some embodiments, the headphone assembly 10 may resolve a triggering problem experienced by certain other sensing techniques. For example, the pressure sensor 12 and associated control elements may be set to trigger when the pressure sensor experiences a pressure level of at least a predetermined threshold level or falling within a predetermined pressure range. Upon detection of a pressure level that reaches the predetermined range or surpasses a predetermined level, the at least one functional element (e.g., one or more controls triggered by the pressure sensor operation) may be initiated. Such an operational configuration may avoid triggering certain control elements unintentionally (e.g., by handling of the headphone) and may more accurately trigger certain control functions in response to actual wearing of the headphone. In some embodiments, one headphone may simultaneously use a plurality of headphone assemblies 10 (e.g., two assemblies, with one associated with each ear) to interactively compare sensing results of the plurality of headphone assemblies 10, thereby providing more diversified detection patterns and a more accurate detection result. In other cases, more than one pressure sensor 12 and associated hardware may be included in each assembly 10.

According to some embodiments of the present application, the headphone assembly 10 may further include an ear pad board 22 located and mounted between the ear pad 18 and the speaker board 14. The ear pad board 22 may be supported on the speaker board 14 and may have a first opening 220. The trigger element 20 may include a first part 201 extending through the first opening 220, and a second part 202 connected to the first part 201 and located between the ear pad 18 and the ear pad board 22. The second part 202 may extend laterally from the first part 201 and may be located outside the ear pad board 22. The first part 201 may press the pressure sensor 12, and the ear pad board 22 may define a pressure threshold applied by the trigger element 20 to the pressure sensor 16. In one embodiment, the trigger element 20 may be one piece (e.g., the first part 201 and the second part 202 may be integrated, may be formed of a single piece of material, etc.).

The second part 202 of the trigger element 20 is not limited to a circular shape shown in the drawings. In some embodiments, the second part 202 may be of a cross structure (or other shaped-structure) extending from the first part, and a length of each part of the cross structure may be adjusted according to an actual condition. The ear pad 18 may surround the second part 202 of the trigger element 20 and a part of the ear pad board 22. In one embodiment, the ear pad 18 may surround an edge of the ear pad board 22, and the ear pad board 22 and the speaker board 14 may be connected through mounting by a fastener.

Figure 2:
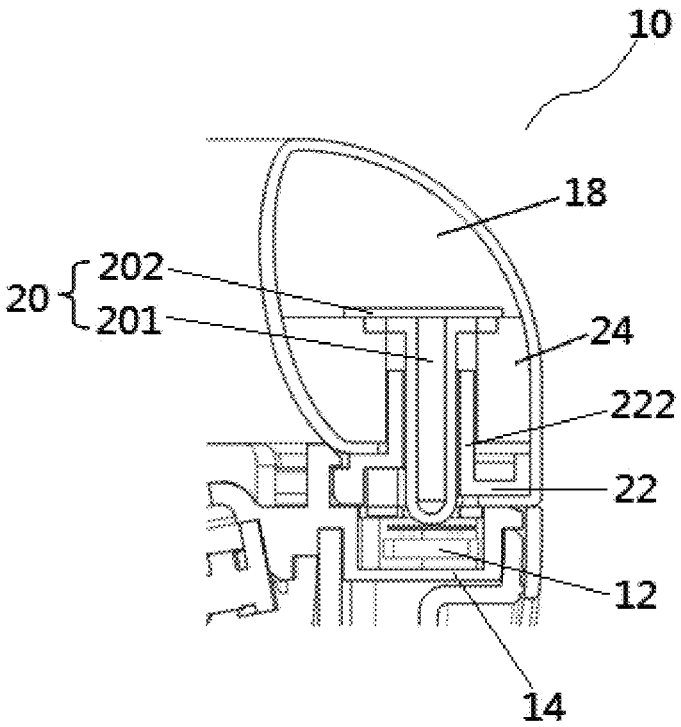
FIG. 2 is a schematic sectional diagram of a structure of an example headphone assembly according to some embodiments of the present application.

According to some embodiments of the present application, referring to FIG. 1 and FIG. 2, FIG. 1 is a schematic exploded diagram of a structure of headphone assembly 10, and FIG. 2 is a schematic sectional diagram of a structure of headphone assembly 10. The sectional view may be taken along a trigger element. The headphone assembly 10 further includes a cushion 24 located between the ear pad 18 and the ear pad board 22 and having a second opening 240. The cushion 24 may be further disposed between the second part 202 of the trigger element 20 and the ear pad board 22. The first part 201 of the trigger element 20 may pass through the second opening 240. The second part 202 of the trigger element 20 may be disposed between the ear pad 18 and the cushion 24. Elasticity of the cushion 24 may allow the trigger element 20 to move. The ear pad 18 and the cushion 24 may be used to realize a spring effect to move an internal structure backward. When the second part 202 of the trigger element 20 is pressed, the trigger element 20 may overcome an elastic force of the cushion 24, so that the first part 201 of the trigger element 20 may be moved from a position spaced apart from the pressure sensor 12 to a position where the pressure sensor 12 is pressed against.

The ear pad board 22 may have a first limit structure 222 extending in at least a part of the second opening 240 and surrounding the first part 201. Movement of the trigger element 20 may enable the cushion 24 to compress or restore, so that the second part 202 of the trigger element 20 may move relative to the first limit structure 222 (e.g., approach or recede relative to).

It should be understood here that the embodiments described above with reference to FIG. 1 and FIG. 2 are merely example embodiments of the present application. Any other suitable structures may be applied in the present application. The present application is not limited to any particular embodiment as long as a detection function described above may be realized.

Figure 3A:
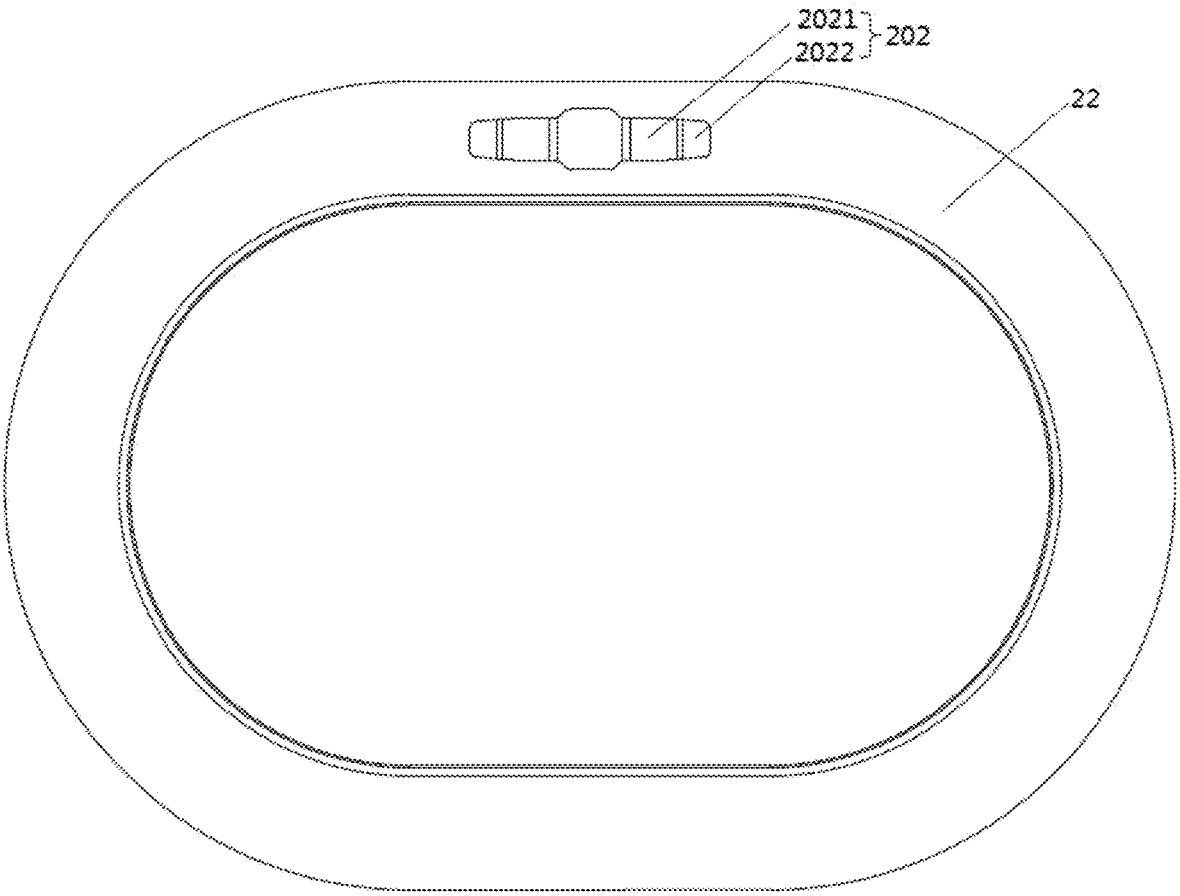
FIG. 3*a* to FIG. 3*d* show a front view, a rear view, a bottom view, and a left view of an ear pad board and a trigger element that are of an example headphone assembly according to some embodiments of the present application.
Figure 3B:
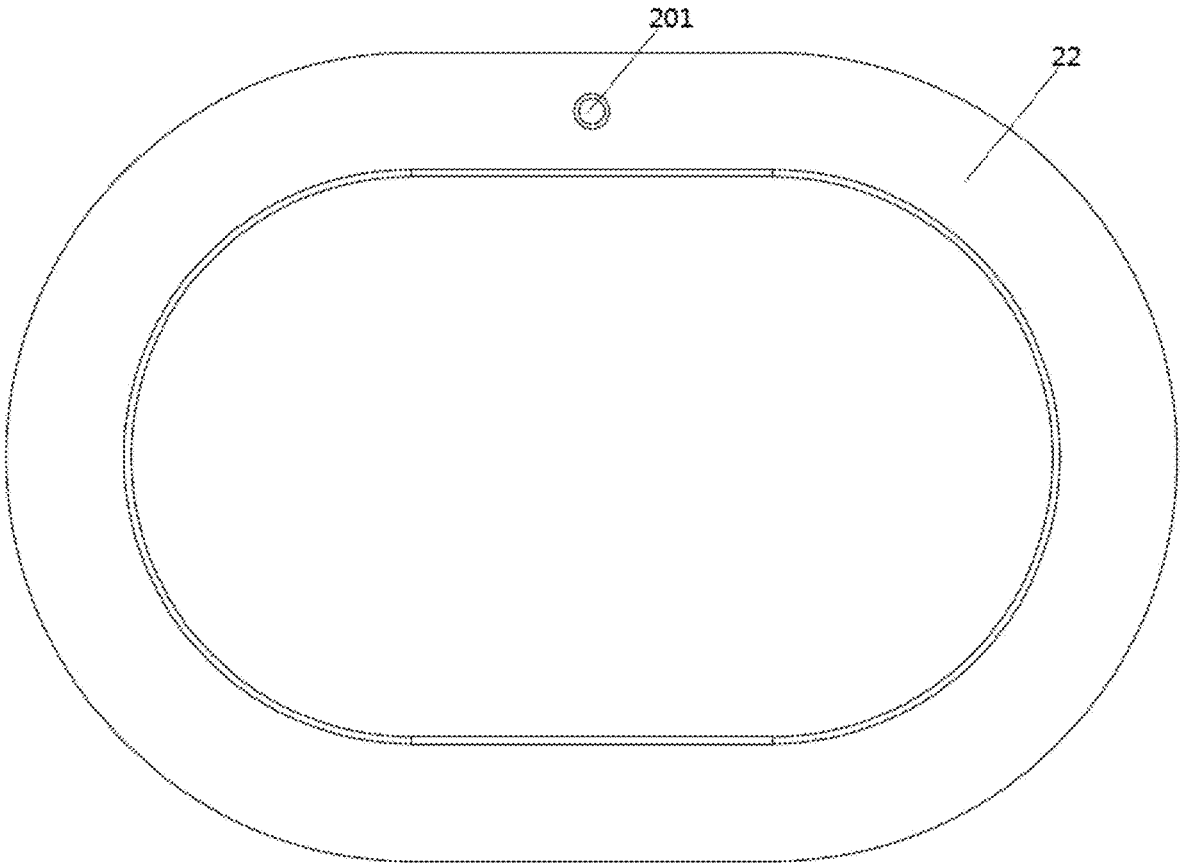
Figure 3C:
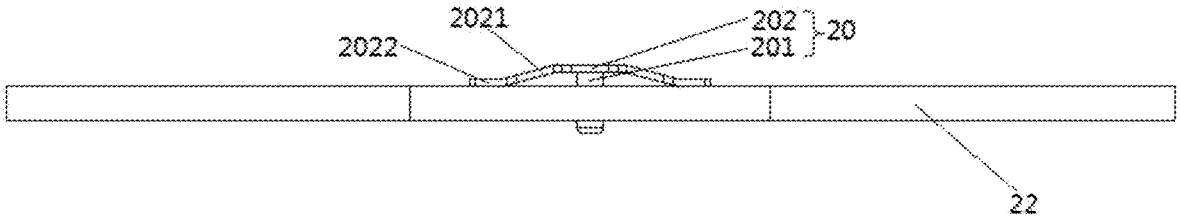
Figure 3D:
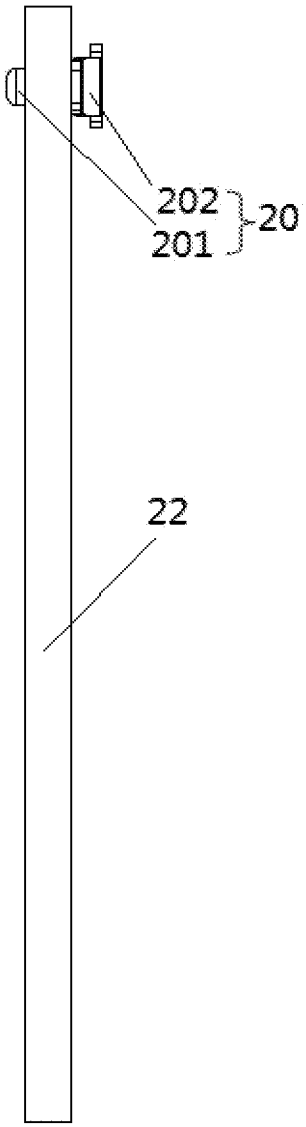
Figure 4:
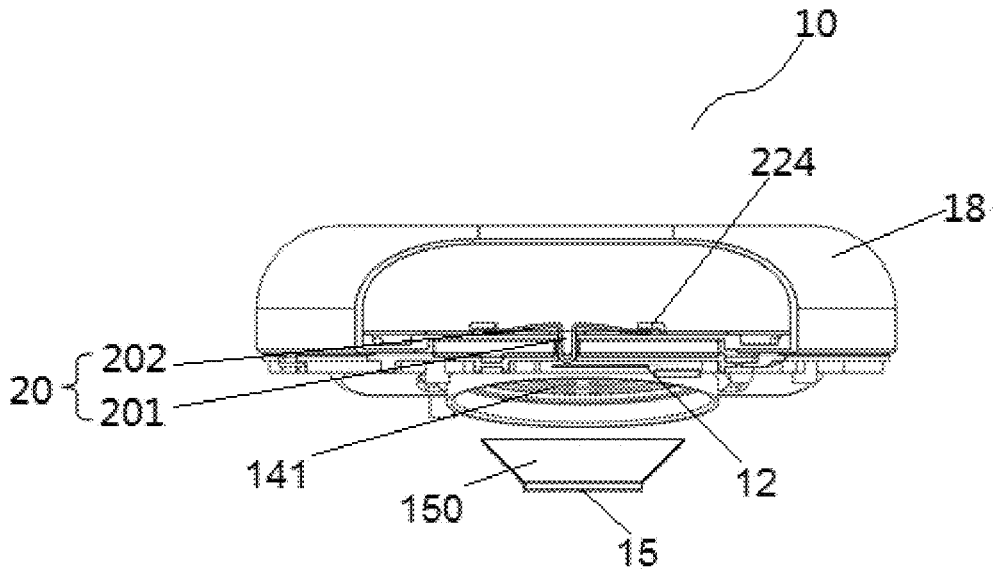
FIG. 4 is a schematic sectional diagram of a structure of an example headphone assembly according to some embodiments of the present application.

According to some embodiments of the present application, referring to FIG. 3*a* to FIG. 4, FIG. 3*a* to FIG. 3*d* respectively show various examples of a front view, a rear view, a bottom view, and a left view in which the ear pad board 22 and the trigger element 20 that are of the headphone assembly 10 cooperate with each other according to the present application. FIG. 4 is a schematic sectional diagram of a structure of the headphone assembly 10 according to some embodiments of the present application. In FIG. 4, the trigger element 20 and other elements may cooperate with each other. FIG. 4 may be a cross-sectional view of a part of a headphone assembly 10 taken along an axis of a trigger element 20. Rebound of the trigger element 20 may be realized by virtue of its own elasticity. Referring to FIG. 3*a* to FIG. 4, the second part 202 of the trigger element 20 may have a slope instead of a flat surface in a natural state. When the trigger element 20 is pressed, the slope of the second part 202 may provide a compression space, and when the trigger element 20 is released from being pressed, the trigger element may rebound through its own elasticity.

Referring to FIG. 3*a* to FIG. 4, the second part 202 of the trigger element 20 may have elasticity and may be constructed as an elastic restoring element supported on the ear pad board 22. An edge 2022 of the second part 202 of the trigger element 20 may contact the ear pad board 22 (e.g., as shown in FIG. 3*c*). When the trigger element 20 is moved, the edge 2022 of the second part 202 may be moved relative to the ear pad board 22, so that a central part 2021 of the second part moves away from or approaches the ear pad board 22. In a lateral direction, the central part 2021 of the second part 202 may be closer to the first part 201 than the edge of the second part 202. For example, the second part 202 of the present application may be of a structure having elasticity and a variable shape, and may be of an arched structure in a natural state compared to the ear pad board 22. In some embodiments, when the trigger element 20 is pressed, the second part 202 may be flexed toward the ear pad board 22, so that the first part 201 may contact and press the pressure sensor 12. In cases where the ear pad 18 does not press the trigger element 20, the second part 202 may remain arched relative to the ear pad board 22, and a center of the second part 202 may remain displaced away from the ear pad board 22. In such cases, pressure applied by the first part 201 to the pressure sensor 12 may be reduced, or the first part 201 may remain separated from the pressure sensor 12 altogether. Such an arrangement may enable control responses to varying levels of detected pressure values.

In some embodiments, plastic (PP) may be used as a forming material of the second part 202 of the trigger element 20. Based on pressure that the ear pad 18 transmits to the elastic restoring element, the second part 202 serving as the elastic restoring element may switch the first part 201 of the trigger element 20 between a position where the pressure sensor 12 is pressed against and a position spaced apart from the pressure sensor 12. The second part 202 may have a relatively large extension area to cooperate with the ear pad 18 and the cushion 24.

In some embodiments, the ear pad 18 and the cushion 24 may be integrated over the second part 202 of the trigger element 20, and the cushion 24 may be accommodated in the ear pad 18 to absorb and disperse pressure. In some embodiments, the entire trigger element may be disposed below the ear pad 18 and the cushion 24, and the second part 202 of the trigger element 20 may be located between the cushion 24 and the ear pad board 22. Pressure applied to the ear pad 18 may be transmitted to the second part 202 through the cushion 24. In this case, even if the ear pad 18 and the cushion 24 are only partially pushed, the trigger element 20 may be moved sufficiently (at least in some cases) to trigger the sensor. The ear pad board 22 may include a second limit structure 224 for accommodating an edge part, and the second limit structure 224 may include a protrusion part protruding from the ear pad board 22 and an extension part extending laterally through connection to and perpendicular to the protrusion part, so as to form an accommodation space that accommodates the edge part.

With a headphone assembly 10 and headphone controlling method of the present application, headphone wearing behavior of a user may be detected by using a simple and convenient detection method, which may improve sensitivity of wearing detection of a headphone. A space and a load required for wearing detection may also be reduced, so that an integration level of the headphone can be improved, leaving more room for developing other functional elements of the headphone.

Beneficial technical effects of the present application may include providing an improved headphone assembly and an improved headphone controlling method to provide an improved wearing detection mode, so as to improve user experience of wearing a headphone by a user.

In accordance with some embodiments, the present disclosure provides a headphone assembly, including: a switching element for controlling a switch of at least one functional element in a headphone; a pressure sensor accommodated in a groove of a speaker board; and an ear pad covering the groove, wherein when the ear pad is pressed, a trigger element may be moved to press against the pressure sensor, wherein when detecting that pressure applied by the trigger element reaches a predetermined range, the pressure sensor switches on the switching element, otherwise, the pressure sensor switches off the switching element. In an embodiment, the headphone assembly may further include an ear pad board mounted between the ear pad and the speaker board, wherein the ear pad board is supported on the speaker board, and the trigger element has a first part passed through the ear pad board to press the pressure sensor and a second part extended laterally from the first part and located outside the ear pad board. In an embodiment, the headphone assembly may further include a cushion located between the second part of the trigger element and the ear pad board, wherein when the second part of the trigger element is pressed, the trigger element overcomes an elastic force of the cushion, so that the first part of the trigger element is moved from a position spaced apart from the pressure sensor to a position where the pressure sensor is pressed against. In an embodiment, the second part of the trigger element may be constructed as an elastic restoring element supported on the ear pad board, wherein based on a pressure that the ear pad transmits to the elastic restoring element, the elastic restoring element switches the first part of the trigger element between a position where the pressure sensor is pressed against and a position spaced relative to the pressure sensor. In an embodiment, the headphone assembly may further include a cushion accommodated in the ear pad, wherein the second part of the trigger element is located between the cushion and the ear pad board, and pressure applied to the ear pad is transmitted to the second part through the cushion. In an embodiment, the trigger element may be an integrally molded piece. In an embodiment, the speaker board may have a grille part corresponding to a membrane of a speaker and an annular part surrounding the grille part, the groove is disposed on the annular part.

In accordance with some embodiments, the present disclosure provides a headphone controlling method, including: pressing a trigger element through an ear pad; the trigger element which has been pressed moving toward a pressure sensor disposed in a speaker board to press against the pressure sensor; detecting a pressure value applied by the trigger element through the pressure sensor; and switching on at least one functional element of the headphone when the pressure value reaches a predetermined range, otherwise switching off the at least one functional element. In an embodiment, when the trigger element is separated from the pressure sensor, the method may include switching off the at least one functional elements. In an embodiment, the at least one functional element may include a speaker.

The foregoing description is merely illustrative of the example embodiments of the present application and is not intended to be limiting the present application, and for those skilled in the art, the present application may have various changes and modifications. Any modifications, equivalent substitutions, improvements, or the like within the spirit and principles of the application are intended to be included within the scope of the present application.

What is claimed is:

1. A headphone assembly, comprising:

a switching element for controlling a switch of at least one functional element in a headphone;

a pressure sensor accommodated in a groove of a speaker board;

an ear pad covering the groove; and a trigger element within the headphone assembly and covered by the ear pad, wherein the ear pad is configured such that when the ear pad is pressed, the trigger element is moved to press against the pressure sensor, wherein the pressure sensor is configured such that in response to a detected pressure at the pressure sensor applied by the trigger element that reaches a predetermined range, the pressure sensor switches on the switching element, and wherein the pressure sensor is further configured such that in response to a detected pressure applied by the trigger element that does not reach the predetermined range or in an absence of pressure applied to the pressure sensor by the trigger element, the pressure sensor switches off the switching element or maintains the switching element in an off state.

2. The headphone assembly of claim 1, further comprising:

an ear pad board mounted between the ear pad and the speaker board, wherein the ear pad board is supported on the speaker board, wherein the trigger element comprises a first part passed through the ear pad board to press the pressure sensor and a second part extending laterally from the first part and located outside the ear pad board.

3. The headphone assembly of claim 2, further comprising:

a cushion located between the second part of the trigger element and the ear pad board, wherein in response to the second part of the trigger element being pressed, the trigger element overcomes an elastic force of the cushion, so that the first part of the trigger element is moved from a position spaced apart from the pressure sensor to a position where the trigger element presses against the pressure sensor.

4. The headphone assembly of claim 2, wherein the second part of the trigger element is constructed as an elastic restoring element supported on the ear pad board, and wherein based on a pressure that the ear pad transmits to the elastic restoring element, the elastic restoring element switches the first part of the trigger element between a position where the pressure sensor is pressed against and a position spaced relative to the pressure sensor.

5. The headphone assembly of claim 4, further comprising:

a cushion accommodated in the ear pad, wherein the second part of the trigger element is located between the cushion and the ear pad board, and pressure applied to the ear pad is transmitted to the second part through the cushion.

6. The headphone assembly of claim 1, wherein the trigger element is an integrally molded piece.

7. The headphone assembly of claim 1, wherein the speaker board comprises a grille part corresponding to a membrane of a speaker and an annular part surrounding the grille part, wherein the groove is disposed on the annular part.

8. A headphone controlling method, comprising:

pressing a trigger element through an ear pad, covering the trigger element, to cause the trigger element to move toward a pressure sensor disposed in a speaker board to press against the pressure sensor;

detecting a pressure value applied by the trigger element through the pressure sensor; and switching on at least one functional element of the headphone when the pressure value reaches a predetermined range, and switching off the at least one functional element or maintaining the at least one functional element in an off state when the pressure value does not reach the predetermined range.

9. The headphone controlling method of claim 8, further comprising:

when the trigger element is separated from the pressure sensor, switching off the at least one functional element.

10. The headphone controlling method of claim 8, wherein the at least one functional element comprises a speaker.

* * * * *